US005868630A

United States Patent [19]

Saksun, Jr.

[11] Patent Number: 5,868,630

[45] Date of Patent: Feb. 9, 1999

[54] GOLF COURSE INDICATOR DEVICE

[75] Inventor: John Saksun, Jr., Toronto, Canada

[73] Assignee: Cansak Products Limited, Toronto, Canada

[21] Appl. No.: 795,561

[22] Filed: Feb. 6, 1997

[51] Int. Cl.[6] ..... A63B 57/00

[52] U.S. Cl. ..... 473/150; 40/217; 404/13

[58] Field of Search ..... 473/150, 405, 473/407; 40/124.1, 217, 606, 607, 608; 52/103, 105; 33/700, 701; 116/209, 222; 404/9, 10, 11, 13

[56] References Cited

U.S. PATENT DOCUMENTS

| | | | |
|---|---|---|---|
| D. 367,238 | 2/1996 | Jambor . | |
| 1,435,363 | 11/1922 | Wood | 40/608 |
| 2,154,966 | 4/1939 | Vanderveer . | |
| 3,102,359 | 9/1963 | Cahill et al. | 116/209 |
| 3,427,933 | 2/1969 | Taylor-Myers | 404/9 |
| 3,599,981 | 8/1971 | Zausmer . | |
| 3,634,961 | 1/1972 | Nawalaniec . | |
| 3,699,913 | 10/1972 | Sautbine . | |
| 3,916,821 | 11/1975 | Pies . | |
| 3,920,348 | 11/1975 | Paulos . | |
| 4,218,059 | 8/1980 | Eiden | 404/11 |
| 4,302,125 | 11/1981 | Cullen, Jr. . | |
| 4,364,688 | 12/1982 | Bitvai | 40/607 |
| 4,484,669 | 11/1984 | Carman | 473/150 |
| 4,649,678 | 3/1987 | Lamson . | |
| 4,738,060 | 4/1988 | Marthaler . | |
| 4,783,071 | 11/1988 | Tattershall . | |
| 4,871,280 | 10/1989 | Modlin | 404/11 |
| 4,978,245 | 12/1990 | White | 404/10 |
| 5,072,940 | 12/1991 | Bailey . | |
| 5,186,119 | 2/1993 | Hlavin . | |
| 5,219,171 | 6/1993 | Kirby . | |
| 5,263,166 | 11/1993 | Darling . | |
| 5,263,262 | 11/1993 | Steere . | |
| 5,335,151 | 8/1994 | Dahlberg . | |
| 5,357,897 | 10/1994 | Bailey . | |
| 5,441,257 | 8/1995 | Sheaffer . | |
| 5,467,729 | 11/1995 | Yamada . | |
| 5,474,301 | 12/1995 | Wilson . | |
| 5,593,156 | 1/1997 | Jambor | 473/150 |

FOREIGN PATENT DOCUMENTS

| | | |
|---|---|---|
| 75176 | 11/1994 | Canada . |
| 2111144 | 6/1995 | Canada . |
| 2142778 | 1/1996 | Canada . |

*Primary Examiner*—Steven Wong

[57] ABSTRACT

A golf course indicator for providing information to golfers to help in club selection and understanding course layout. The indicator includes a generally planar upper surface which includes indicia for providing information to a golfer and a post mount for releasably attaching a post to the upper surface. The releasable attachment allows a post to be nondestructively removed from the post mount. A skirt is formed below the upper surface which ends at a bottom face and forms a hollow body. The upper face has a first area and the bottom face has a second area, the second area being greater than the first area to facilitate securing the device into the ground. The device is sized and shaped to fit into a hole in the ground. In a further embodiment the invention includes a post for mounting in the post mount, the post including a lower section sized and shaped to permit the post to be knocked out of the post mount without damaging either the post or the post mount.

20 Claims, 2 Drawing Sheets

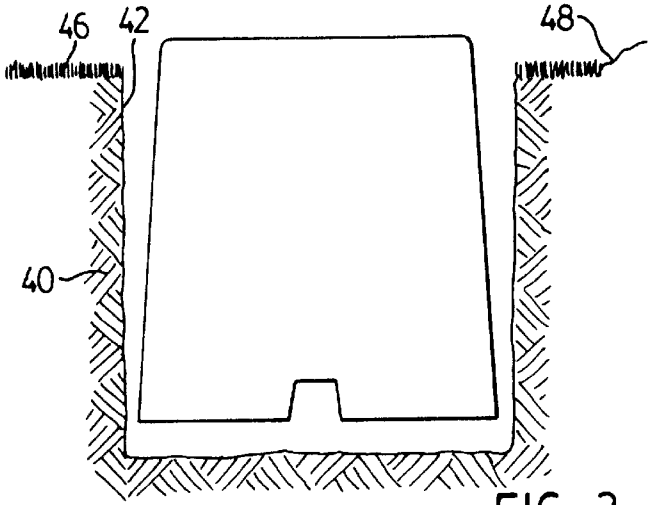
FIG. 3
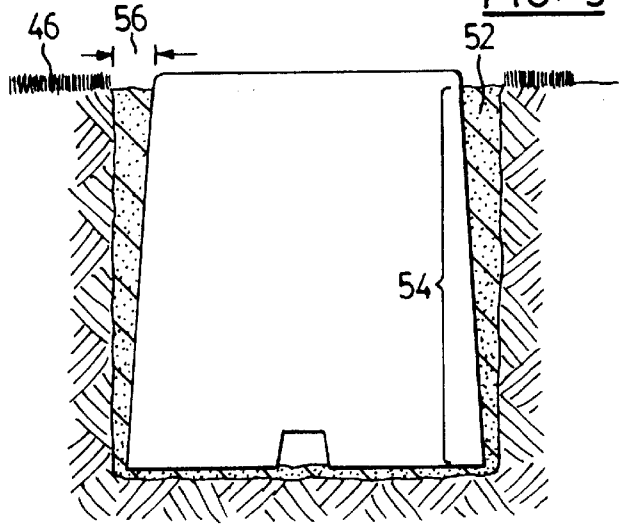
FIG. 4
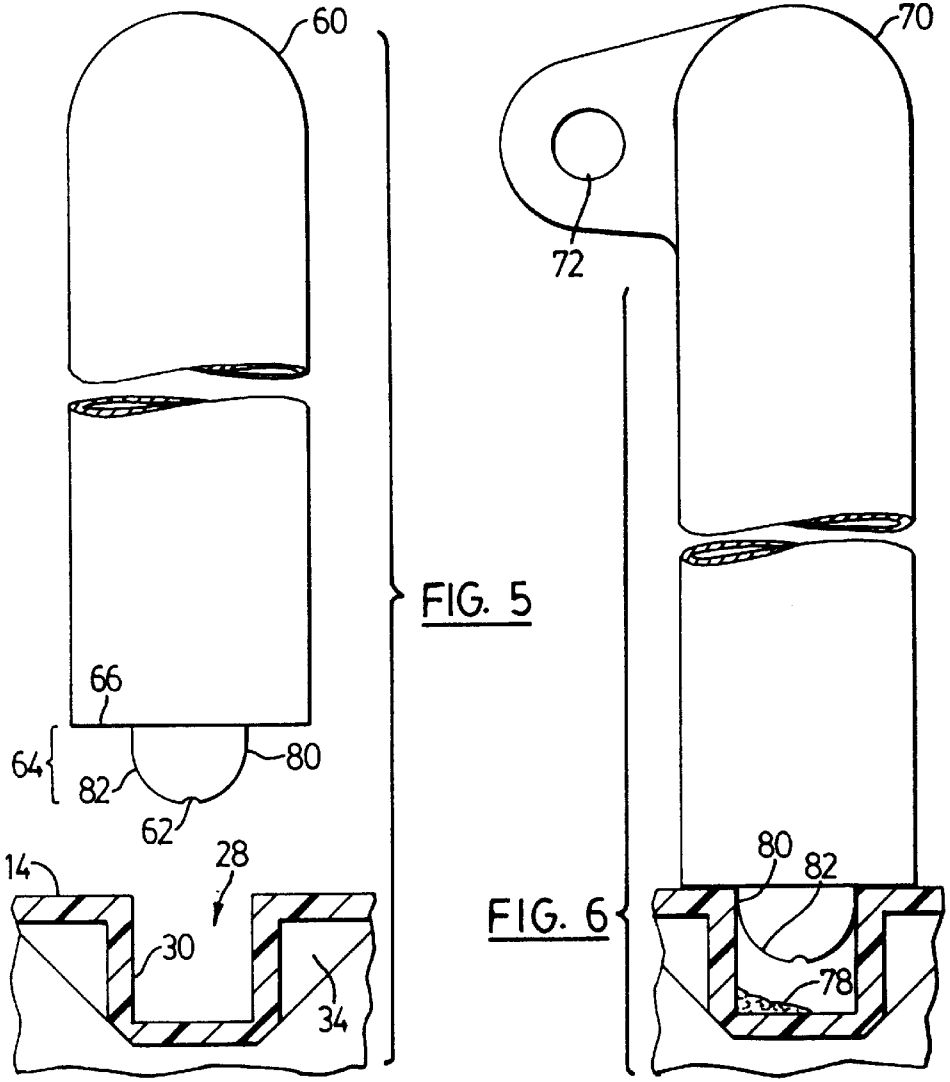
FIG. 5
FIG. 6

GOLF COURSE INDICATOR DEVICE

FIELD OF THE INVENTION

This invention relates to the field of sports and recreation and more particularly to the field of golf. Most particularly this invention relates to golf equipment of the type used to mark a golf course to facilitate playing the game of golf.

BACKGROUND OF THE INVENTION

It has been long recognized that choosing the right club, to make an approach shot to the green, is an essential part of the game of golf. Of course, because every player is unique, even two players hitting identical balls off identical clubs will tend to hit to different distances. Thus each player must identify and understand how far they are likely to hit each club that they might choose for a given shot. But knowing how far one hits the ball off a given club is of no use if one does not know how far away the target green is. Therefore golf courses tend to provide distance markers, beside or on the golf course fairways, to assist the golfer in measuring the distance from where the last shot came to rest and the target green.

Typically golf courses will provide markers at one or more of the distances of two hundred yards, one hundred and fifty yards and sometimes even at one hundred yards. Also, it is typical to provide yardages at other convenient marking places, such as on sprinkler heads. Sprinkler heads are located according to watering needs and thus are only found at random locations on the course. Such random and widely spaced markers are not sufficiently convenient. Often time is wasted as a golfer locates his or her ball, retraces their steps back to the closest distance marker and the paces off the distance to the ball, thereby being able to determine the distance to the green and select what is hoped to be an appropriate club for them.

Due to rising popularity of the game of golf, more and more players are trying to play on golf courses. This is creating even greater need to keep play moving smoothly and efficiently. A delay by one group trying to gauge the distance to the green and pacing up and down from infrequent fairway markers has a frustrating compounding effect as the delay moves backwards through the course. A short delay on one part of the course tends to create ever larger delays for groups playing behind. Thus a number of systems have been proposed in the past to try to provide visible and frequent yardage markers to more quickly and easily provide the needed distance information to golfers in an effort to make it easier and quicker for the golfer to complete a round of golf.

Examples of such systems and devices may be found in the following prior patents:

| | |
|---|---|
| Steere, Jr. | U.S. Pat. No. 5,263,262 |
| Darling | U.S. Pat. No. 5,231,166 |
| Kirby et al. | U.S. Pat. No. 5,219,171 |
| Cullen Jr. | U.S. Pat. No. 4,302,125 |
| Paulos | U.S. Pat. No. 3,920,348 |
| Zausmer | U.S. Pat. No. 3,599,981 |
| Vanderveer | U.S. Pat. No. 2,154,966 |

In one prior device, as shown by Jambor U.S. Design Pat. No. 367,238, there is provided a ground marker in the form of an inverted cup. This device is provided with a transparent top face under which various information, such as advertising may be placed. This device is provided with an outwardly projecting side edge which bears against the side of a hole. The device is intended to be removed to permit the advertising to be replaced at frequent intervals. Thus, a special tool is also taught for removing the device from the ground.

However, this prior device has several disadvantages. In the first place, the device is a multi-part device which is expensive to make and assemble. Further the device is bulky and difficult to transport and handle. The device is also located at ground level, but relies on the removal and reinsertion of the device to remain visible in growing grass. This could add greatly to the work of greens keepers who are not likely to want to or to have the time to go around the golf course pulling up and then reinserting the markers. Lastly, the prior device includes a raised lip around the top surface, which tends to trap dirt, grass clippings and the like on the top surface. This also requires attention to ensure that the markings remain visible.

What is desirable is to provide a more visible indication of the markers location such as by using an associated marking post. The form of a suitable marking post is another aspect that has received considerable attention lately. In addition distance marking such posts are conventionally used to provide marking for hazards or out of bounds areas. An ideal post is both highly visible and convenient and inexpensive to install. One approach is to provide posts which are capable of being ridden over by lawn cutting equipment, without needing removal. Examples of marking posts are taught in the following patents:

| | |
|---|---|
| Sheaffer | U.S. Pat. No. 5,441,257 |
| Bailey | U.S. Pat. No. 5,357,897 |
| Hlavin | U.S. Pat. No. 5,186,119 |
| Bailey | U.S. Pat. No. 5,072,940 |
| Marthalor | U.S. Pat. No. 4,738,060 |
| Lamson | U.S. Pat. No. 4,649,678 |

However, these devices are expensive multi-part devices which may still create problems for lawn mowing equipment.

SUMMARY OF THE INVENTION

Although there are a large number of prior devices, none are in common use on North American golf courses at present. What is required is a simple inexpensive and reliable marking post and golf course indicator system that can be conveniently installed and yet which does not increase maintenance costs for golf course owners. Preferably such a system would be useful in providing golf course indicators and in providing posts for signifying lateral or water hazards, out of bounds areas and the like.

Most preferably such a system would be formed from one piece components that would be easy and efficient to make, for example out of molded plastic. Such a system would also preferably have a series of uses, both with posts and without. Because of the time involved in the installation of the devices, the system should also be able to be permanently installed, without needing any changes from year to year. It should not need any special tools to be placed and should not be easily removable. Having such a permanent set of golf course indicators and markers would greatly speed up spring opening, by not requiring careful reestablishment of out of bounds or hazard lines every new season.

In addition, a system should be adaptable to different uses, from providing easily visible yardages to players, to marking out of bounds and hazard areas, to even providing temporary crowd control fencing on tournament courses.

Further the system should be composed of durable elements that will be rugged and not easily damaged and which do not require unusual maintenance. Most preferably the components should be designed to accommodate the occasional contact with an inexpertly driven golf cart or the like without requiring replacement. Lastly the system should not impose any excessive burden on the golf course staff to care for the components.

Therefore the system is provided according to one aspect of the present invention a golf course indicator for golf courses comprising:

a generally planar upper surface;

indicia, associated with said upper surface, for providing information to a golfer;

a post mount associated with said upper surface for releasably attaching a post to said upper surface, said releasable attachment permitting the nondestructive detachment of a post from said upper surface;

a skirt extending below said generally planar upper surface and forming a hollow body, said skirt ending in an open bottom face opposite to said planar top face wherein said body in a first cross-section has a first area and in a second area cross-section has a second area, said second cross-section being below said first cross-section, said second area being greater than said first area whereby said body tapers from said second area toward said first area; and wherein said second area is sized and shaped to fit into a hole formed by a green hole cutting tool.

In another aspect of the invention there is provided a hollow plastic marking post, comprising a lower mounting element for registering with the post mount of said golf course indicator, said marking post being releasably retained in said post mount.

BRIEF DESCRIPTION OF THE DRAWINGS

Reference will now be made to preferred embodiments of the present invention by way of reference only in which:

FIG. 3 is a side view of a yardage indicator of the present invention being lowered into a hole in the ground;

FIG. 4 is a side view of the yardage indicator of FIG. 3 installed in the hole;

FIG. 5 is a side view of a yardage indicator post for the invention of FIG. 1; and FIG. 6 is a side view of an alternate marker post for the invention of FIG. 1.

DETAILED DESCRIPTION OF THE PREFERRED EMBODIMENTS

Figure 1:
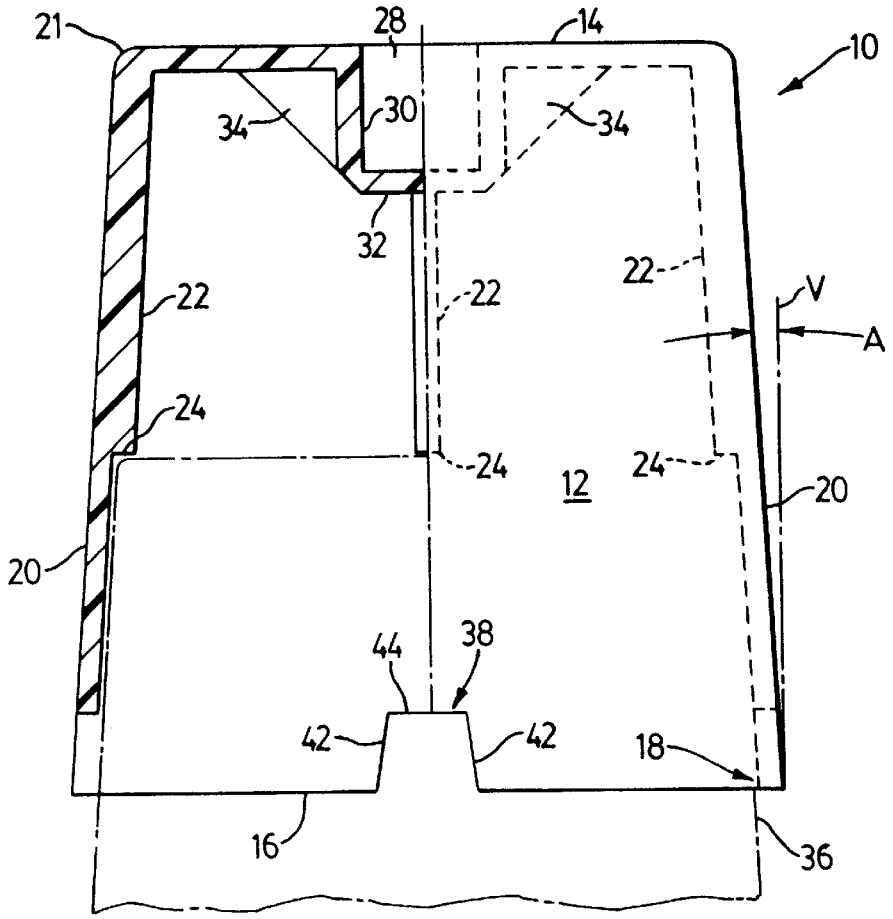
FIG. 1 is a side view in part section of an indicator device according to one aspect of the present invention.

A golf course indicator according to the present invention is indicated in FIG. 1 generally at 10. The term golf course indicator, as used in this application means a device which is able to impart information to a golfer, where the information is useful to playing the game of golf. For example, the indicator can indicate yardages by for example bearing a distance or could by a color indicate a water, lateral or other hazard or an out of bounds.

The golf course indicator 10 is preferably in the form of a one-piece body 12, which is preferably made from molded plastic such as polypropylene, but is most preferred to be made from high density polyethylene or the like. It will be appreciated by those skilled in the art that various types of plastic could be used, but what is desired is a plastic, or a plastic mixture which is readily moldable, and yet which has both good color fastness and long term strength and stability in spite of continual exposure to the sun. In some cases it may be desirable to use a U.V. blocker in the plastic to increase the durability of the plastic and hence the life of the product.

The body includes a top face 14 and a bottom face 16. The bottom face is open as shown at 18. Extending between the top face 14 and the bottom face 16 is a continuous skirt or side wall 20. In the most preferred form of the invention, the side wall 20 is circular in plan although other shapes in plan could also be used without altering the function or utility of the golf course indicator 10. Also, it is most preferred to provide rounded shoulders 21 between the top face 14 and the skirt 20. This ensures that any dirt or the like on the top surface 14 will be easily washed off by rain, sprinklers or the like, without requiring any special maintenance.

Most preferably the side walls are 0.125" thick, although the side walls could be made of any thickness between 0.04" and 0.5", providing that sufficient strength was achieved for the side walls as described below. Of course, with a greater thickness more material is required which increases the costs of manufacture of the device. The total height of the device could be between about 3" and 6", with the most preferred height being between 4" and 5". This height provides reasonable stability in the ground, provides a sufficiently large top surface 14 to be quite visible and yet is not so large as to require excess effort to insert the device in the ground as described below.

Extending inwardly from the side walls are ribs, indicated as 22 with ends 24 which are described in more detail below. Although four ribs 22 are shown in the drawings, it will be appreciated by those skilled in the art that more or fewer ribs 22 could be used and that three ribs 22 will also give adequate results.

Turning to the top face 14, there is provided a post mount, which includes a central opening 28 and a downwardly extending bore 30 with a closed bottom 32. Also, provided are triangular reinforcing ribs 34. The triangular reinforcing ribs 34 can have any desired shape. The ribs 34 are provided between the bore 30 and an underside of top face 14, and they provide additional strength to prevent the downwardly extending bore 30 from being too easily bent or manipulated during use as described more fully below.

While in some instances it would be possible to provide the bore 30, extending upwardly, above the top face 14, this is less preferred. What is desired is to provide a golf course indicator which may be generally flush with the ground surface, with a generally planar top surface 14, which is positioned below the level of any cutting blades of mowers or the like. In this manner, mowers can pass over the golf course indicator 10 without requiring its removal, and without damaging the device.

In the most preferred embodiment the opening 28 is centrally located to facilitate accurate distance measurement. It will be appreciated by those skilled in the art that the post mount could be placed at almost any location in the top face 14, provided enough support was available to the bore 30. In some cases having an offset opening 28 would be beneficially, in that a larger area for marking indicia could be provided.

Returning to the side walls 20, it can be seen that between a vertical axis identified as V in FIG. 1 and the side wall 20, there is an angle A. Angle A may be referred to as a taper angle and is preferably between 0.050° and 15°, more preferably between 2° and 40° and most preferably about 3°. The taper angle A provides a number of important advantages to the present invention including that like golf course indicators are nestable in one another, as set out in more detail below.

Figure 2:
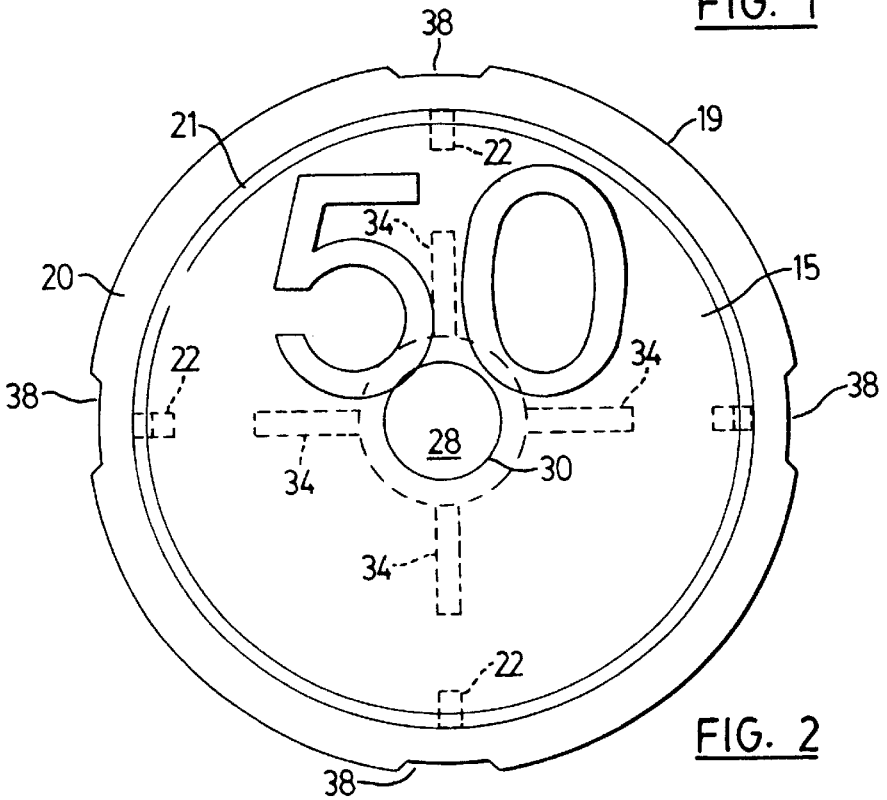
FIG. 2 is a top view of the yardage indicator of FIG. 1.

It can now be appreciated that the top face 14 will have a first area in plan, shown as 15 in FIG. 2, and the open bottom face 18 will have a second area in plan, shown as 19 in FIG. 2. According to the present invention, the first area 15, is less than the second area 19, and the body tapers from the second area 19 to the first area 14 as shown. While reference is made to the first area being at the upper surface, it will be appreciated that the first area could be considered as occurring at any first cross-section on the body. Similarly, the second area could be considered as occurring at any second area section on the body, providing the first cross-section was above the second cross-section and the second area was larger than the first area. In this manner the body of the indicator will be larger below, and difficult to remove through a narrow upper opening in the ground.

It will be appreciated by those skilled in the art that the shape of the first and second areas can be varied. Although depicted as circles in the Figures, the present invention comprehends that these areas could be squares, rectangles, or multi-sided polygons. What is required is to provide an upper planar surface 14 for displaying indicia to a golfer, as more fully described below, in combination with a body which is readily made and easy to use.

The nesting aspect of the present invention can now be more fully understood. Shown as 36 in FIG. 1 is a second golf course indicator nesting in the open 18 bottom face 16 of the golf course indicator 10. In this manner the amount of volume taken up by a plurality of the golf course indicators 10 is reduced for shipping and handling. Additionally, a stack of golf course indicators such as may be required for providing a number of yardages on any given hole or to set out a boundary line, can be nested together and kept easily in one place.

It can now be appreciated more clearly how the ribs 22 function. By reason of the taper, when two like indicators are nested together, there is a chance for the air to be driven out of the space between the two units. Then, when the time comes for separating the units, a negative pressure or vacuum would exist making it very hard to separate the two units. Thus, the ribs 22 form stops, at their lower ends 24, which prevent one unit from being over-inserted into another unit and to permit the devices to be readily separated for use.

Also shown in FIGS. 1 and 2 is a plurality of ground engaging notches 38 which are formed in a lower edge 40 of the bottom face 16. Each notch includes opposed side edges 42 and a top edge 44. In the preferred embodiment four notches 38 are provided, as shown in FIG. 2, but it will be appreciated by those skilled in the art that more or fewer could be provided if desired. The purpose of the notches 38 is to allow the golf course indicator 10 to more easily seat into the ground against dirt and small objects such as stones, roots or the like. It will be appreciated that the exact shape and size of the notches 38 can be varied, and in particular more notches 38 can be provided or the notches 38 could be made wider or higher. What is desired is to provide a lower edge which is more easily seated in the ground than a circular rim. The step of installing the present invention in the ground is explained in more detail below.

Turning to FIG. 2, it can be seen that the generally planar top face 14 is provided with a numerical indicator such as 50, which is shown in FIG. 2. The number shown should be large enough to be clearly visible and yet not so large as to be obscured by a post inserted into the device as described below. Thus, in some cases it may be desirable to reduce the size of the number so as to avoid being overlain by the bottom of a post.

The numeral 50 is intended to denote the distance to the center of the green and various numbers will be placed onto the top face depending upon the distance required to be marked. Thus, the distance will be measured, and a device inserted which bears the number corresponding to the measured distance. The preferred form of marking on the top surface 14 is to use a foil plastic laminate which is heat stamped onto the top surface 14 and which causes the numbers, formed of a different colored plastic than the golf course indicator to fuse into the plastic top face 14. In this manner a permanent highly visible mark is made. The most preferred form of coloring is to have a white body, with black numbering. This foil stamping is also desirable because it does not create any raised contours in the top surface 14 around the numbers. Thus there will be no tendency to trap dirt or the like which will otherwise obscure the information being conveyed.

In addition to a numerical indicator as shown, there may be also nonnumerical indicators such as a small circle of color, the letter Y in yellow, the letter R in red or the like. In this case, a red or yellow indication could be used to indicate a hazard. A different indicator, either a color or a symbol such as OB, could be used to indicate out of bounds. In keeping with convention golf course markings it may be preferred to simply make out of bounds markers white.

It can now be appreciated that in this manner, the top face of the golf course indicator can be appropriately marked to provide information to the golfer to assist the golfer in playing the game of golf on the golf course. As such the top face 14 provides indicia to a golfer to facilitate the smooth and efficient playing of a round of golf.

It will be appreciated that the present invention can be provided at many locations on a golf course, most preferably in a defined pattern. For example, when used as yardage markers, the devices could be provided every 10 yards, every 20 yards or the like, and placed in a predetermined location, such as down the center of the fairway or at any other convenient location. In this way enough detailed distance information would be provided to help club selection. For hazards or out of bounds, the indicators could be placed as needed to delineate the line being marked.

Turning back to FIG. 2, also shown are the notches 38, the ribs 22 and the triangular reinforcing ribs 34. With respect to the ribs 22 and 34, as can be seen, there are four in the preferred embodiment. However, the number can be varied to suit the structural requirements and the type of plastic and thicknesses being used.

Turning to FIG. 3, the golf course indicator 10 according to the present invention is shown being installed in the ground 40. Most preferably, a hole 42 is formed in the ground 40 having a diameter approximately equal to the open bottom face 16 of the golf course indicator 10. It may be convenient to size the golf course indicator 10 to fit within a hole formed by the conventional green's hole forming tool used to cut the holes for golf course greens. In such a case, the bottom face 16 is preferred to have an outside diameter of about 4.25" and the top face 14 is preferred to have a diameter of about 3.8". The central bore 30 is preferred to have an internal diameter of about 0.75".

In some cases it may be preferred, for increased visibility, to make the diameters larger, in which case a larger diameter hole cutting tool would be required. However, whether the conventional greens hole size is used or any other size is used, the object is to provide a hole in the ground which substantially accommodates the open bottom face and is slightly less than the height of the golf course indicator 10. In this manner, the golf course indicator 10 can be placed in the hole and pushed firmly into the dirt at the bottom of the hole until the device is below the level of the top of the grass 46 as shown in FIG. 4. Thereafter, loose dirt 48 can be placed around the golf course indicator 10 as indicated at 52 and tamped down. The most preferred height is for the device to be slightly above the dirt line (but below the cut grass line), to encourage dirt, grass clippings and the like to wash off the top surface with rain or sprinklers in a "self-cleaning" manner.

It can now be appreciated that the taper angle A of the skirt 20 has a further function beyond nesting as set out above. By reason of the taper, the golf course indicator will not be readily removable from the ground. Over time the tamped down loose dirt or other packing material such as gravel, sand, particulates or the like will bond to the side wall of the hole, forming an inverted wedge 54 around the skirt 20 to prevent it from being easily removed. This will prevent vandals from making off with the indicators and will prevent the device from shifting during climate changes. In this manner the present invention provides a more or less permanent insertion of the golf course indicator 10 into the ground.

As can also be seen in FIG. 4, the tamped down ground or dirt around the taper body 12 of the golf course indicator 10 also provides a temporarily grass free ring 56 around the top of the indicator 10. This enhances the visibility of the indicator to golfers until the grass grows over the tamped down earth ring 56.

Turning to FIG. 5, a marking post 60 according to a further aspect of the present invention is shown. The marking post 60 is preferably made from plastic material and is a hollow blow molded article. A blow mold hole is provided at 62 on an insertion end 64. A planar surface 66 interfaces with the top face 14 of the golf course indicator 10.

The post 60 can be of any desired height but is preferably between 0.5 feet and 2 feet high and most preferably about 1 foot high. In some cases it may be preferable to use a slightly longer post, such as marking an out of bounds line in deep grass. The post 60 can also be made of any color, and, will be marked yellow, white or other colors as appropriate for indicating different aspects of the golf course, whether a hazard, out of bounds, or a distance.

Shown in FIG. 6 is a different embodiment of the marking post 60, which is indicated with numeral 70. This marking post is generally longer, two feet or higher, and may extend 3 to 5 feet above the ground. A rope retaining loop 72 is provided on the post 70 for extending a rope between a plurality of posts. In this way, temporary gallery restraint can be provided by simply mounting a post of an appropriate height into the golf course indicator 10 of the present invention. In this aspect the indicator 10 could be unobtrusively placed in a ring around a tee, green or the like. Then, when the gallery restraint was needed, a plurality of posts could be inserted to form an instant rope barrier.

As can be seen in FIG. 6, the insertion end 64 of marking posts 60 or 70 are provided with a part cylindrical portion 80, which ends in a generally semi-rounded portion 82. The part cylindrical portion 80 is sized to form an interference fit in the downwardly extending bore 30 of the golf course indicator 10. Thus, the insertion end 64 is sized and shaped to be retained in the bore 30. Upon being forced laterally, the post will tip and then fall over without damaging the insertion end 64 or, without displacing the golf course indicator 10 in the ground, by reason of the rounded end portion 82. The rounded end portion 82 in essence allows the insertion end 64 to pivot out of the bore 30, no matter from what direction a blow is received. It has been found that a cylindrical portion of between 0.1" and 0.5" provides reasonable results.

Thus, the insertion end is sized and shaped to be releasably retained in the bore 30, in a manner which permits the nondestructive knock down of the post, in the event of accidental contact with a golf cart, mower or the like. It is also to be noted that the blow molding hole 62 allows the posts to be inserted into the bore 30 without working against air pressure. Also, it is desirable to make the depth of the bore 30 greater than the length of the insertion end 64. In this way, if a post is not inserted for a period of time, some dirt 78 or the like can be accumulated in the bore 30, and yet will not interfere with the posts 60 and 70.

It can now be appreciated that the present invention provides a releasable knock down mount for the post on the top surface 14 of the golf course indicator 10. Although the interference fit of the insertion end 64 achieves good results, other modes of releasable attachment may also be used, such as a magnetic attachment, or a Velcro attachment. Both of these require additional manufacturing steps and so are not as desirable, but could be made to work in some conditions.

It will be apparent to those skilled in the art that the foregoing description is in respect of preferred embodiments of the invention. Various modifications and alterations can be made to the invention without departing from the scope of the exclusive property or privilege claimed as indicated in the attached claims. For example, while any number of ribs could be provided, what is required is a combination of ribs and plastic thickness which provides a solid stable golf course indicator which is strong enough to be partially planted in the ground. Additionally, while the releasable attachment of the post can be made in various ways, what is required is for the posts to have a secure and yet nondestructively knock down attachment, such as provided by an interference fit of the post end into the downwardly extending bore for the purpose of retaining the posts in position against inconsequential contact such as wind or the like.

I claim:

1. A golf course indicator device for golf courses comprising:

a generally planar upper surface;

indicia, associated with said upper surface, for providing information to a golfer;

a post mount associated with said upper surface for releasably attaching a post to said upper surface, said releasable attachment permitting the non-destructive detachment of a post from said upper surface;

a skirt extending below said generally planar upper surface and forming a hollow body, said skirt ending in an bottom face opposite to said planar top face wherein said body in a first cross-section has a first area and in a second cross-section has a second area, said second cross-section being below said first cross-section, said second area being greater than said first area to facilitate securing said device in the ground; and wherein said second area is sized and shaped to fit into a hole formed by a hole cutting tool.

2. A golf course indicator as claimed in claim 1 wherein said skirt tapers between said first area and said second area.

3. A golf course indicator as claimed in claim 2 wherein said bottom face is open.

4. A golf course indicator as claimed in claim 3 wherein said first cross-section is at said upper surface and said second cross-section is at said open bottom face.

5. A golf course indicator as claimed in claim 1 wherein said indicia comprise distance markings marked onto the upper planar surface.

6. A golf course indicator as claimed in claim 1 wherein said indicia comprise color markings to denote one or more of a hazard, a boundary line or other information about the golf course relevant to a golfer.

7. A golf course indicator as claimed in claim 1 wherein said generally planar upper surface is round and said post mount is located at the center of the surface.

8. A golf course indicator as claimed in claim 7 wherein said post mount comprises an orifice formed in said upper planar surface into which a marking post may be inserted.

9. A golf course indicator as claimed in claim 7 wherein said post mount is a downwardly extending closed tube, and said body further includes reinforcing means extending between an underside of said generally planar upper surface and said downwardly extending closed tube.

10. A golf course indicator as claimed in claim 2 wherein said body tapers sufficiently to permit two or more of said ground markers to be at least partially nested together to reduce shipping volume and to facilitate handling of a plurality of said indicators.

11. A golf course indicator as claimed in claim 2 wherein said taper is sufficient to permit a packing material to be packed around said generally planar upper surface, form an inverted wedge to facilitate holding said indicator in the ground.

12. A golf course indicator as claimed in claim 1 wherein said hollow body is a one piece molded plastic article.

13. A golf course indicator as claimed in claim 12 wherein said plastic is high density polyethylene.

14. A golf course indicator as claimed in claim 1 wherein said skirt includes a nonlinear lower edge to facilitate the seating of said body in dirt at bottom of a hole formed in the ground.

15. A golf course indicator as claimed in claim 1 further including a hollow plastic marking post, comprising a lower mounting element for registering with said post mount, said marking post being releasably retained by said post mount.

16. A golf course indicator as claimed in claim 15 wherein lower mounting element is a shaft section, sized and shaped to form an interference fit in said post mount, and terminating in a rounded lower section, wherein said rounded lower section is sized and shaped to permit said post to be knocked down out of said marker body without damaging either said post or said post mount.

17. A golf course indicator as claimed in claim 10 wherein said body includes nesting stops to facilitate the easy removal of one nested indicator from another, by preventing an indicator from being over inserted into another indicator.

18. A golf course indicator as claimed in claim 1 wherein said body has a height of between 3 inches and 6 inches.

19. A golf course indicator as claimed in claim 15 wherein said hollow marking post has a height of between 6 inches and 2 feet.

20. A golf course indicator as claimed in claim 15 wherein said post is two feet high or taller and said post includes a rope retaining means to facilitate making a rope gallery fence.

* * * * *